US010526168B2

(12) United States Patent
Litteral et al.

(10) Patent No.: US 10,526,168 B2
(45) Date of Patent: Jan. 7, 2020

(54) SERVICE ALARM DEVICE FOR WARNING IF AN ELEVATOR SAFETY DEVICE IS NOT ACTIVATED

(71) Applicant: Otis Elevator Company, Farmington, CT (US)

(72) Inventors: Kenneth P. Litteral, Florence, SC (US); Kurt J. Frei, Las Vegas, NV (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 555 days.

(21) Appl. No.: 15/331,637

(22) Filed: Oct. 21, 2016

(65) Prior Publication Data

US 2017/0113900 A1 Apr. 27, 2017

Related U.S. Application Data

(60) Provisional application No. 62/244,999, filed on Oct. 22, 2015.

(51) Int. Cl.

| | |
|---|---|
| ***B66B 1/34*** | (2006.01) |
| ***B66B 5/00*** | (2006.01) |
| ***B66B 9/00*** | (2006.01) |
| ***B66B 3/00*** | (2006.01) |
| ***B66B 5/02*** | (2006.01) |
| ***B66B 1/28*** | (2006.01) |

(52) U.S. Cl.

CPC ..... *B66B 5/0043* (2013.01); *B66B 1/28* (2013.01); *B66B 3/00* (2013.01); *B66B 5/005* (2013.01); *B66B 5/0031* (2013.01); *B66B 5/025* (2013.01); *B66B 9/00* (2013.01)

(58) Field of Classification Search

CPC ..... B66B 5/0043; B66B 1/28; B66B 3/00; B66B 5/0031; B66B 5/005; B66B 5/025; B66B 9/00

USPC ..... 187/247, 277, 391, 393, 394, 396

See application file for complete search history.

(56) References Cited

U.S. PATENT DOCUMENTS

| | | | | |
|---|---|---|---|---|
| 5,347,094 | A | 9/1994 | Leone et al. | |
| 5,644,111 | A * | 7/1997 | Cerny | B66B 13/14 187/280 |
| 6,138,798 | A | 10/2000 | Macuga | |
| 6,202,797 | B1 | 3/2001 | Skolnick et al. | |
| 6,223,861 | B1 | 5/2001 | Sansevero | |

(Continued)

FOREIGN PATENT DOCUMENTS

| | | | |
|---|---|---|---|
| CN | 101277892 | A | 10/2008 |
| CN | 101602456 | A | 12/2009 |

(Continued)

OTHER PUBLICATIONS

European Patent Office, Extended European Search Report for Application No. 16195077.9, dated Mar. 16, 2017.

(Continued)

*Primary Examiner* — Anthony J Salata
(74) *Attorney, Agent, or Firm* — Cantor Colburn LLP

(57) ABSTRACT

A service alarm device for use in an elevator system, the service alarm device including a control board configured to receive at least one safety signal, and an alarming device in communication with the control board, wherein the control board is configured to activate the alarming device based on the at least one safety signal.

23 Claims, 4 Drawing Sheets

(56) References Cited

U.S. PATENT DOCUMENTS

| | | | | |
|---|---|---|---|---|
| 6,550,585 | B2 * | 4/2003 | Schoppa | B66B 5/005 187/280 |
| 6,603,398 | B2 * | 8/2003 | Tinone | B66B 13/22 187/316 |
| 6,630,886 | B2 | 10/2003 | Malone, Jr. | |
| 7,201,256 | B2 | 4/2007 | Deplazes et al. | |
| 7,832,526 | B2 | 11/2010 | Sirigu | |
| 7,954,606 | B2 | 6/2011 | Tinone et al. | |
| 8,261,885 | B2 | 9/2012 | Ketoviita et al. | |
| 8,365,870 | B2 | 2/2013 | Sirigu et al. | |
| 8,490,755 | B2 * | 7/2013 | Lindberg | B66B 13/22 187/314 |
| 8,556,043 | B2 | 10/2013 | Mangini et al. | |
| 8,602,171 | B2 | 12/2013 | Vogl | |
| 8,875,845 | B2 | 11/2014 | Nygren | |
| 9,272,878 | B2 * | 3/2016 | Kocher | B66B 5/005 |
| 9,630,804 | B2 * | 4/2017 | Hovi | B66B 5/005 |
| 10,112,802 | B2 * | 10/2018 | Dube | B66B 5/0031 |
| 10,118,798 | B2 * | 11/2018 | Kattainen | B66B 5/0031 |
| 2002/0117358 | A1 | 8/2002 | Schoppa et al. | |
| 2008/0223667 | A1 | 9/2008 | Tinone et al. | |
| 2012/0305334 | A1 | 12/2012 | Kocher et al. | |
| 2019/0062109 | A1 * | 2/2019 | Nanjappan | B66B 5/005 |

FOREIGN PATENT DOCUMENTS

| | | | |
|---|---|---|---|
| CN | 202338763 | U | 7/2012 |
| EP | 2080725 | B1 | 5/2015 |
| JP | S6469484 | A | 3/1989 |
| JP | H07330237 | A | 12/1995 |
| WO | 2007018540 | A1 | 2/2007 |

OTHER PUBLICATIONS

Chinese Office Action from application CN 201610924532.3, dated May 15, 2019, 6 pages.

* cited by examiner

SERVICE ALARM DEVICE FOR WARNING IF AN ELEVATOR SAFETY DEVICE IS NOT ACTIVATED

CROSS-REFERENCE TO RELATED APPLICATIONS

The present application is a nonprovisional patent application, which claims priority to U.S. Patent Application No. 62/244,999, filed Oct. 22, 2015 which is herein incorporated in its entirety.

TECHNICAL FIELD OF THE DISCLOSED EMBODIMENTS

The present disclosure is generally related to elevator systems and, more specifically, a service alarm device for an elevator system.

BACKGROUND OF THE DISCLOSED EMBODIMENTS

Generally, elevator mechanics endure risks associated with the maintenance and installation of elevator systems due to unexpected movement of the elevator car. There is therefore a need for safety devices to warn an elevator mechanic that the elevator car is not secured for service or installation.

SUMMARY OF THE DISCLOSED EMBODIMENTS

In one aspect, an elevator system is provided. The elevator system includes an elevator shaft including an elevator pit and a lowest landing, wherein the lowest landing includes a hoistway door. The elevator system further includes an elevator car disposed within the elevator shaft, the elevator car configured to travel within the elevator shaft. The elevator system further includes an elevator drive in communication with the elevator car, the elevator drive configured to control movement of the elevator car. The elevator system further includes an elevator safety device in communication with the elevator drive, the elevator safety device configured to control movement of the elevator car when placed in a service mode. The elevator system further includes a service alarm device in communication with the elevator safety device, wherein the service alarm device includes a controller configured to receive at least one safety signal, and an alarming device in communication with the controller, wherein the controller is configured to transmit at least one alarm signal to the alarming device based on the at least one safety signal.

In an embodiment, the elevator safety device includes a first switching device located in the elevator pit, wherein the first switching device is configured to transmit a first safety signal. In the preceding embodiments, the elevator system further includes a first sensing device in communication with the service alarm device, wherein the first sensing device is located at the bottom landing and is configured to transmit a second safety signal, and a second sensing device in communication with the service alarm device, wherein the second sensing device is located on the hoistway door and is configured to transmit a third safety signal. In the prior embodiments, the service alarm device is configured to activate an alarm signal if the second safety signal and the third safety signal are active, and the first safety signal is inactive.

In an embodiment, the elevator system further includes an access opening located adjacent to the elevator pit, and a third sensing device in communication with the service alarm device, wherein the third sensing device is located on the access opening and configured to transmit a fourth safety signal. In the preceding embodiment, the service alarm device is configured to activate at least one alarm signal if the fourth safety signal is active and the first safety signal is inactive.

In another embodiment, the service alarm device further includes an alarm switching device in communication with the controller. The alarm switching device is configured to transmit a fifth safety signal. In the prior embodiment, the elevator safety device includes a second switching device located on top of the elevator car, wherein the second switching device is configured to transmit a sixth safety signal. In the preceding embodiments, the controller is configured to activate the alarming device if the fifth safety signal is active and the sixth safety signal is inactive. In this embodiment, the elevator system further includes an auxiliary service device in communication with the service alarm device. The auxiliary service device is configured to temporarily disable the alarming device.

In any of the preceding embodiments, the alarming device includes at least one of a visual alarm and an audible alarm.

In one aspect, a maintenance safety assembly for use in an elevator system is provided. The assembly includes an elevator safety device configured to control movement of an elevator car when placed in a service mode, and a service alarm device in communication with the elevator safety device. The service alarm device includes a controller configured to receive at least one safety signal and an alarming device in communication with the controller, wherein the controller is configured to transmit at least one alarm signal to the alarming device based on the at least one safety signal.

In an embodiment of the assembly, the elevator safety device includes a first switching device configured to transmit a first safety signal. In any of the preceding embodiments, the assembly further includes a first sensing device in communication with the service alarm device, wherein the first sensing device is configured to transmit a second safety signal, and a second sensing device in communication with the service alarm device, wherein the second sensing device is configured to transmit a third safety signal. In the preceding embodiment of the assembly, the service alarm device is configured to activate an alarm signal if the second safety signal and the third safety signal are active, and the first safety signal is inactive.

In another embodiment, the assembly further includes a third sensing device in communication with the service alarm device, wherein the third sensing device is configured to transmit a fourth safety signal. In this embodiment, the service alarm device is configured to activate at least one alarm signal if the fourth safety signal is active and the first safety signal is inactive.

In another embodiment of the assembly, the service alarm device further includes an alarm switching device in communication with the controller, wherein the alarm switching device is configured to transmit a fifth safety signal. In this embodiment, the elevator safety device includes a second switching device, wherein the second switching device is configured to transmit a sixth safety signal. In the preceding embodiments of the assembly, the controller is configured to activate the alarming device if the fifth safety signal is active and the sixth safety signal is inactive. In the preceding embodiments, the assembly further includes an auxiliary service device in communication with the controller, wherein the auxiliary service device is configured to temporarily disable the alarming device.

In any embodiment of the assembly, the alarming device includes at least one of a visual alarm and an audible alarm.

Other embodiments are also disclosed.

BRIEF DESCRIPTION OF THE DRAWINGS

The embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

DETAILED DESCRIPTION OF THE DISCLOSED EMBODIMENTS

Figure 1:
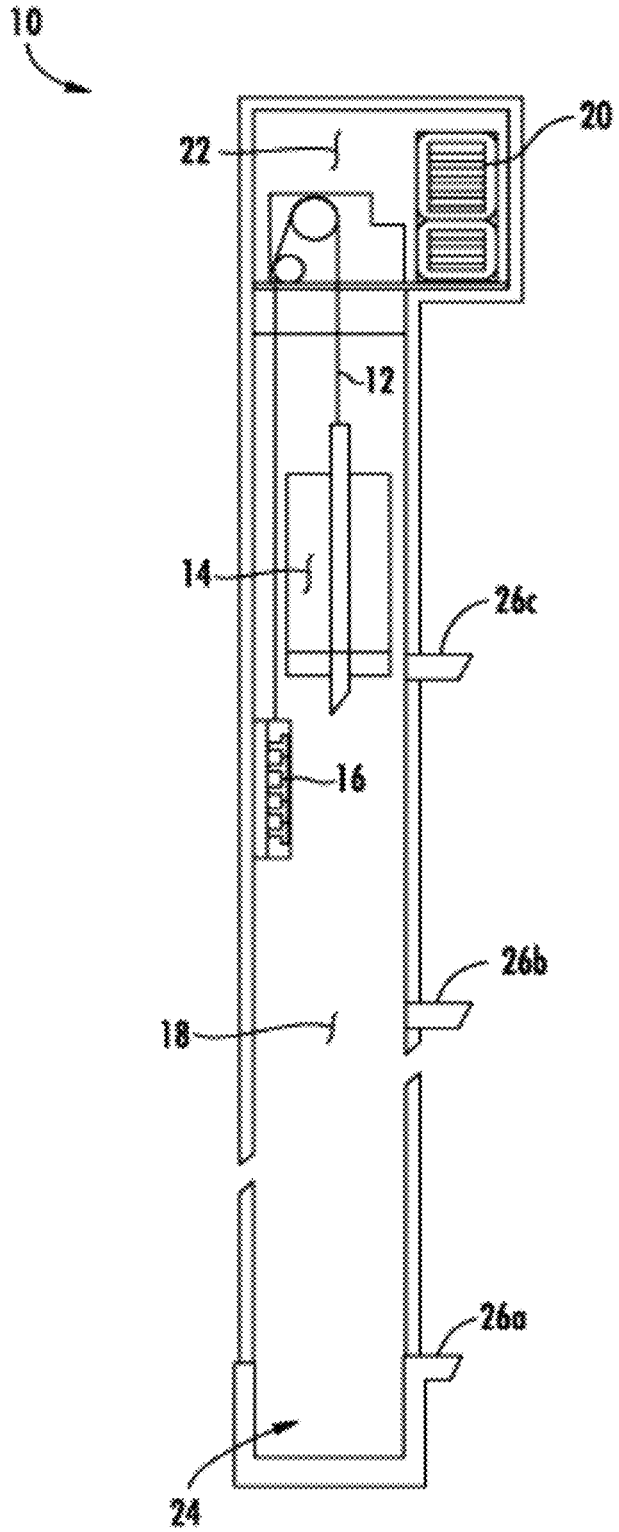
FIG. 1 is a schematic diagram of an elevator system according to an embodiment of the present disclosure.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

FIG. 1 illustrates an elevator system, generally indicated at 10. The elevator system 10 includes cables 12, and an elevator car 14. Cables 12 are connected to the elevator car 14 and a counterweight 16 inside a hoistway 18. The car 14 moves up and down the hoistway 18 by force transmitted through cables or belts 12 to the elevator car 14 by an elevator drive 20 commonly located in a machine room 22 at the top of the hoistway 18. The elevator system 10 is configured to stop at a plurality of landings 26A-C to allow passengers to enter and exit the elevator car 14 via a set of hoistway doors 15 (doors 15A at landing 26A shown in FIG. 2) located at the respective landings 26A-C. An elevator pit 24 is located in the bottom of the hoistway 18 below the lowest landing 26A.

Figure 2:
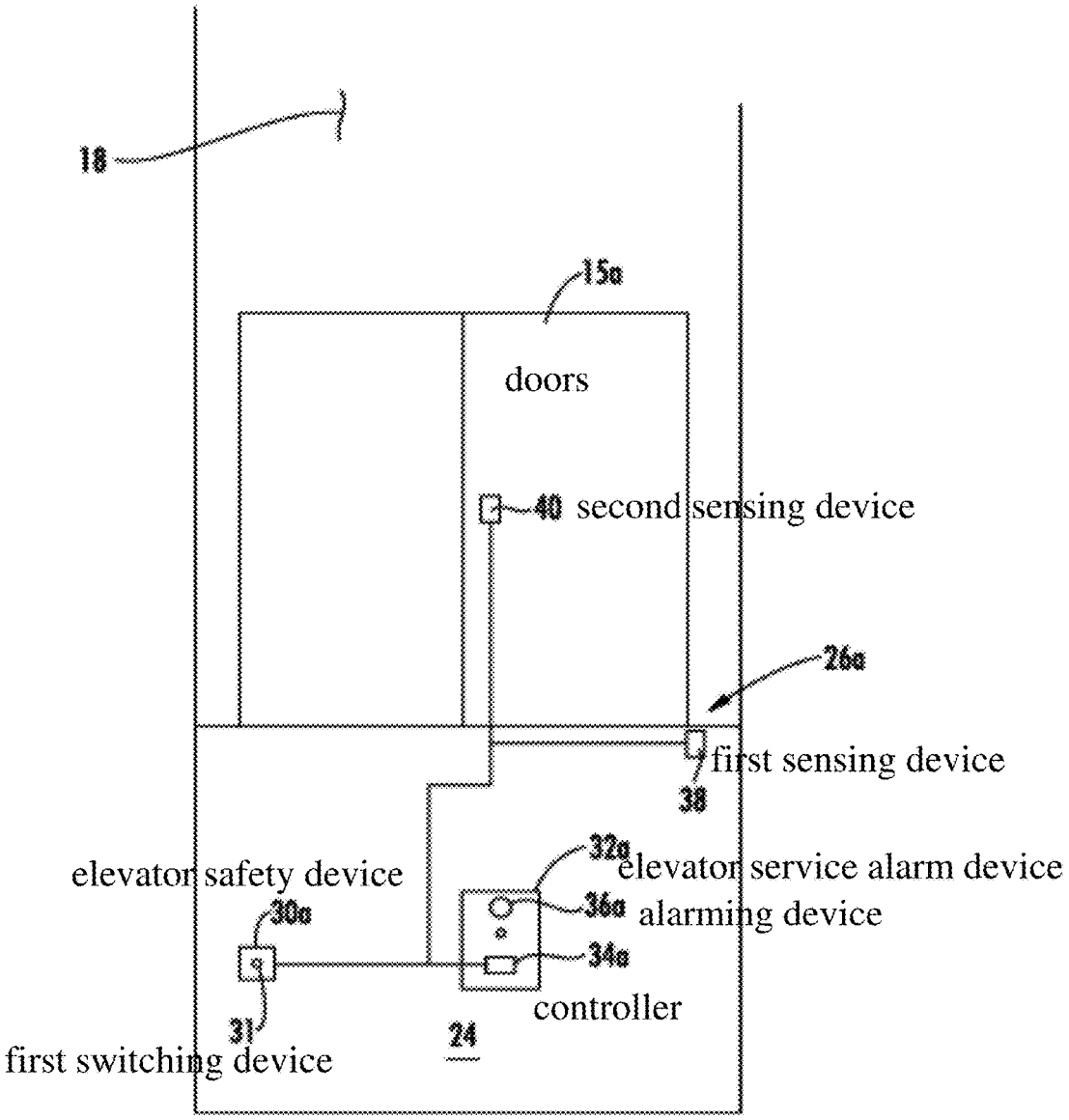
FIG. 2 is a schematic diagram of an elevator pit including a service alarm device according to an embodiment of the present disclosure.

FIG. 2 illustrates a bottom portion of the hoistway 18 in an embodiment. An elevator safety device 30A is located within the elevator pit 24. The elevator safety device 30A may be an elevator pit stop switch including a first switching device 31 in electrical communication with the elevator drive 20. When the first switching device 31 is activated, the elevator pit stop switch 30A is configured to transmit a first safety signal to the elevator drive 20 to prevent unexpected movement of the elevator car 14. It will be appreciated that the first switching device 31 may be a push button, push-pull toggle switch, a switch, etc. to name a few non-limiting examples.

An elevator service alarm device 32A is also located within the elevator pit 24 to provide an elevator mechanic a warning if the elevator safety device 30A is not properly activated. The elevator service alarm device 32A includes a controller 34A. The controller 34A is in electrical communication with the elevator safety device 30A, and the controller 34A is configured to receive the first safety signal from the elevator safety device 30A.

The elevator service alarm device 32A further includes an alarming device 36A in communication with the controller 34A. In an embodiment, the alarming device 36A includes at least one of a visual alarm and an audible alarm. For example, the alarming device 36A may be a buzzer, bell, siren, flashing lights, and/or light emitting diodes, etc. to name a few non-limiting examples. The controller 34A is configured to activate the alarming device 36A based on receiving at least one safety signal.

Shown in the embodiment of FIG. 2, the elevator service alarm device 32A is capable of providing a warning to an elevator mechanic working in the elevator pit 24. The elevator system 10 further includes a first sensing device 38 in communication with the controller 34A. The first sensing device 38 may be located at the lowest landing 26A and is configured to transmit a second safety signal indicating whether the elevator car 14 is located at the lowest landing 26A. A second sensing device 40, located on the hoistway doors 15, may be in communication with the control board 34A. The second sensing device 40 may be configured to transmit a third safety signal indicative of whether the hoistway doors 15 are in an open state or a closed state.

It will be appreciated that the first 38 and second 40 sensing device may be any type of sensing device suitable for the described purpose, for example, a dry contact switch, and a magnetic sensor to name a couple of non-limiting examples. In some embodiments, the elevator drive 20 may transmit any of the first safety signal, second safety signal and third safety signal to the controller 34A based on software inputs indicating the position of the elevator car 14 and the position of the hoistway doors 15.

In the embodiment of FIG. 2, the controller 34A is configured to transmit a first alarm signal to the alarming device 36A if the second safety signal and the third safety signal are active, and the first safety signal is inactive. It will be appreciated that the controller 34A may instead be configured to transmit the first alarm signal if the second safety signal and the third safety signal are inactive based on the arrangement (e.g., normally closed or normally open) of the first sensing device 38 and the second sensing device 40. In some embodiments, the elevator drive 20 may transmit the first alarm signal to the alarming device 36A if the second safety signal and the third safety signal are active, and the first safety signal is inactive.

The first alarm signal causes the alarming device 36A to activate a first alarm (e.g., a visible alarm to name one non-limiting example). After sending the first alarm signal to the alarming device 36A, the controller 34A is configured to transmit a second alarm signal to the alarming device 36A if the second safety signal and the third safety signal are active, and the first safety signal remains inactive for a predetermined period of time after sending the first alarm signal. The second alarm signal causes the alarming device 36A to activate a second alarm (e.g., an audible alarm to name one non-limiting example).

Figure 3:
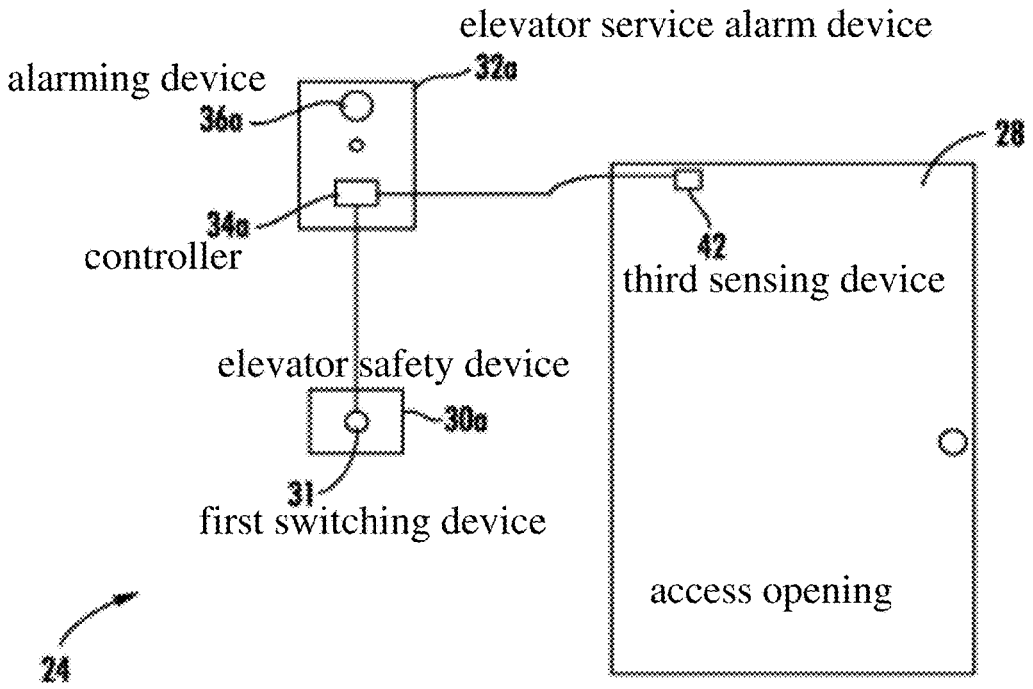
FIG. 3 is a schematic diagram of an elevator pit including a service alarm device according to another embodiment of the present disclosure.

For example, if a service person is either in the elevator pit 24 or entering the elevator pit 24 with the car 14 away from the lowest landing 26A and the hoistway doors 15 in an open position, the elevator safety device 32A will activate an alarm condition (e.g., flashing lights). This alarm condition is triggered because the elevator pit emergency switch 30A has not been activated to stop movement of the elevator car 14, the second sensing device 38 transmits the second safety signal to the control board 34 indicating that the car 14 is away from the lowest landing 26A, and the third sensing device 40 transmits the third safety signal to the controller 34A indicating the hoistway doors 15 are open. In this case, the elevator mechanic will have a pre-determined amount of time (e.g., 5 seconds) to activate the pit emergency stop switch 30A before a second alarm signal (e.g., buzzer or siren) is transmitted to the alarming device 36A The embodiment of FIG. 3 shows another warning system for the elevator mechanic working in the elevator pit 24. In this embodiment, an access opening 28 (e.g. pit access door) is located adjacent to the elevator pit 24 to allow an elevator mechanic to enter and exit the elevator pit 24 to perform service. A third sensing device 42 may be located on the access opening 28, and is in communication with the control board 34A. The third sensing device 42 may be configured to transmit a fourth safety signal indicative of whether the access opening 28 is in an open state or a closed state. It will be appreciated that the third sensing device 42 may be any type of sensing device suitable for the described purpose, for example, a dry contact switch, and a magnetic sensor to name a couple of non-limiting examples.

The controller 34A is configured to transmit at least one alarm signal to the alarming device 36A if the fourth safety signal is active and the first safety signal is inactive. It will be appreciated that the controller 34A may be configured to transmit the at least one alarm signal if the fourth safety signal is inactive based on the arrangement of the third sensing device 42 (e.g., normally closed or normally open). For example, the elevator safety device 32A will activate an alarm condition (e.g., flashing lights) if the access door 28 is in an open position. This alarm condition is triggered because the elevator pit emergency switch 30A has not been activated to stop movement of the elevator car 14, and the third sensing device 42 transmits the fourth safety signal to the controller 34A indicating the access opening 28 is in an open state indicating elevator mechanic may be in the elevator pit 24. In this case, the elevator mechanic will have a pre-determined amount of time (e.g., 5 seconds) to activate the pit emergency stop switch 30A before a second alarm signal (e.g., buzzer or siren) is transmitted to the alarming device 36A.

Figure 4:
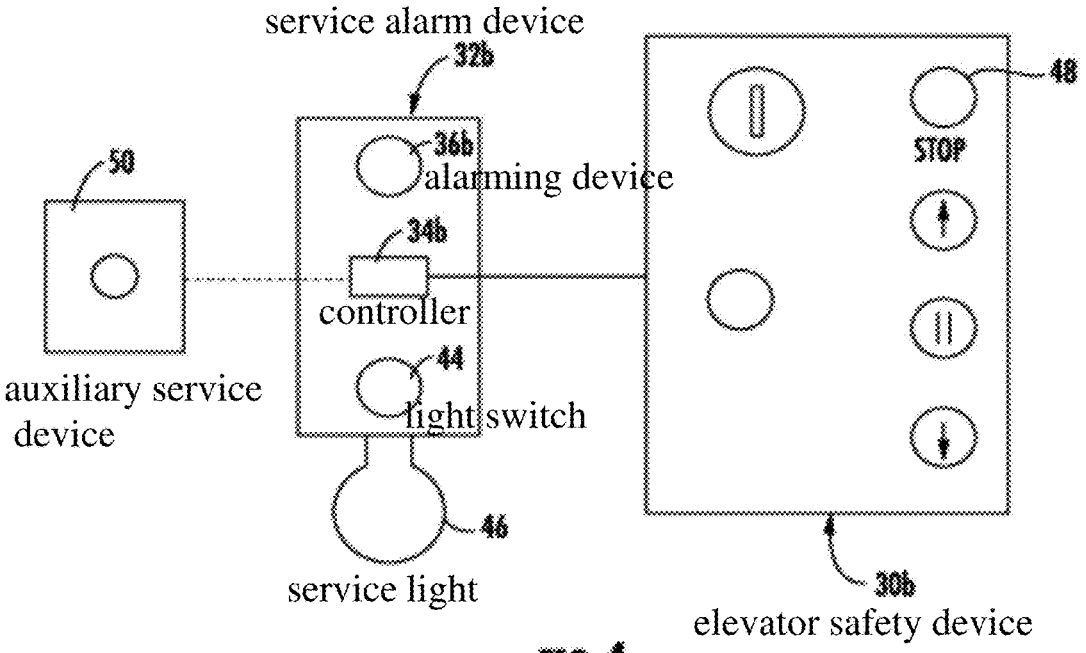
FIG. 4 is a schematic diagram of a service alarm device according to another embodiment of the present disclosure.

FIG. 4 illustrates another embodiment of the service alarm device 32B. In this embodiment, the service alarm device 32B is capable of providing a warning to the elevator mechanic working on top of the elevator car 14. The service alarm device 32B includes the controller 34B in communication with the alarming device 36B, and an alarm switching device 44 in communication with the control board 34B. The alarm switching device 44 is configured to transmit a fifth safety signal. In this embodiment, the fifth safety signal is indicative of whether the service light 46 has been turned on.

The service alarm device 32B is in communication with an elevator safety device 30B. In this embodiment, the elevator safety device 30B may be a car top inspection box located on top of the elevator car 14. The car top inspection box 30B is in electrical communication with the elevator drive 20, and is configured to allow an elevator mechanic to move the elevator car 14 in an up or down direction while performing service from the top of the elevator car 14. In an embodiment, the elevator safety device 30B includes a second switching device 48 (i.e. an inspection stop switch). The second switching device 48 is configured to transmit a sixth safety signal indicative of whether the inspection stop switch has been enabled; thus, the car top inspection box 30B assumes control of movement of the elevator car 14. In some embodiments, the elevator drive 20 may transmit any of the fifth safety signal and sixth safety signal to the controller 34A based on software inputs whether the car top inspection box 30B and light are enabled.

The controller 34B is configured to transmit at least one alarm signal to the alarming device 36B if the fifth safety signal is active and the sixth safety signal is inactive. In some embodiments, the elevator drive 20 is configured to transmit the at least one alarm signal to the alarming device 36B if the fifth safety signal is active and the sixth safety signal is inactive. For example, when the elevator mechanic is on top of the elevator car 14 and activates the service light 46 via the light switch 44; the alarming device 36B is activated. If the inspection stop switch 48 is not enabled within a pre-determined amount of time (e.g. 5 seconds) the control board 34B activates the alarming device 36B to produce a visual and/or audible warning to the elevator mechanic that the inspection stop switch 48 has not been enabled. It will be appreciated that the controller 34B will activate the alarming device 36B anytime the fifth safety signal is active and the sixth safety signal is inactive.

In an embodiment, an auxiliary service device 50 is in communication with the service alarm device 32B. The auxiliary service device 50 is configured to temporarily disable the alarming device 36B if the fifth safety signal is active and the sixth safety signal is inactive. It will be appreciated that the auxiliary service device 50 may be a button, switch, toggle switch, etc. to name a few non-limiting examples.

For example, to perform certain duties while on top of the elevator car 14, the elevator mechanic may need to keep the service light 46 on and move the elevator car 14. This results in the elevator mechanic needing to place the inspection stop switch 48 in an inactive state (i.e. capable of moving the elevator car 14). As such, the elevator mechanic may be able to silence the alarming device 36B by operating the auxiliary service device 50 while moving the elevator car 14 in a desired direction. It will be appreciated that once the elevator mechanic reaches the desired point of service, and deactivates the auxiliary service device 50, the control board 34B will transmit at least one alarm signal to the alarming device 36B until the inspection stop switch 48 is enabled.

It will therefore be appreciated that the present embodiments include a service alarm device 32A-B that may be placed in the elevator pit 24 and/or on top of the elevator car 14, to provide a warning to an elevator mechanic that the elevator system 10 is not properly disabled to safely perform service.

While the disclosure has been illustrated and described in detail in the drawings and foregoing description, the same is to be considered as illustrative and not restrictive in character, it being understood that only certain embodiments have been shown and described and that all changes and modifications that come within the spirit of the disclosure are desired to be protected.

What is claimed is:

1. An elevator system comprising:

an elevator shaft including an elevator pit and a lowest landing, wherein the lowest landing includes a hoistway door;

an elevator car disposed within the elevator shaft, the elevator car configured to travel within the elevator shaft;

an elevator drive in communication with the elevator car, the elevator drive configured to control movement of the elevator car;

an elevator safety device in communication with the elevator drive, the elevator safety device configured to control movement of the elevator car when placed in a service mode;

a service alarm device in communication with the elevator safety device, wherein the service alarm device comprises:

a controller configured to receive at least one safety signal; and an alarming device in communication with the controller;

wherein the controller is configured to transmit at least one alarm signal to the alarming device based on the at least one safety signal to activate an alarm;

wherein the service alarm device is configured to provide a warning if the elevator safety device is not activated as indicated by a first safety signal.

2. The elevator system of claim 1, wherein the elevator safety device comprises a first switching device located in the elevator pit, wherein the first switching device is configured to transmit the first safety signal.

3. The elevator system of claim 1, further comprising:

a first sensing device in communication with the service alarm device, wherein the first sensing device is located at the bottom landing and is configured to transmit a second safety signal; and a second sensing device in communication with the service alarm device, wherein the second sensing device is located on the hoistway door and is configured to transmit a third safety signal.

4. The elevator system of claim 3, wherein the service alarm device is configured to activate an alarm signal if the second safety signal and the third safety signal are active, and the first safety signal is inactive.

5. The elevator system of claim 1 further comprising:

an access opening located adjacent to the elevator pit;

a third sensing device in communication with the service alarm device, wherein the third sensing device is located on the access opening and configured to transmit a fourth safety signal.

6. The elevator system of claim 5, wherein the service alarm device is configured to activate at least one alarm signal if the fourth safety signal is active and the first safety signal is inactive.

7. The elevator system of claim 1, wherein the service alarm device further comprises an alarm switching device in communication with the controller, wherein the alarm switching device is configured to transmit a fifth safety signal.

8. The elevator system of claim 7, wherein the elevator safety device comprises a second switching device located on top of the elevator car, wherein the second switching device is configured to transmit a sixth safety signal.

9. The elevator system of claim 7, wherein the controller is configured to activate the alarming device if the fifth safety signal is active and the sixth safety signal is inactive.

10. The elevator system of claim 7, further comprising an auxiliary service device in communication with the service alarm device, wherein the auxiliary service device is configured to temporarily disable the alarming device.

11. The elevator system of claim 1, wherein the alarming device comprises at least one of a visual alarm and an audible alarm.

12. The elevator system of claim 1, wherein the elevator drive is configured to:

(a) receive the at least one safety signal; and (b) transmit at least one alarm signal to the alarming device based on the at least one safety signal.

13. A maintenance safety assembly for use in an elevator system, the assembly comprising:

an elevator safety device configured to control movement of an elevator car when placed in a service mode; and a service alarm device in communication with the elevator safety device, wherein the service alarm device comprises:

a controller configured to receive at least one safety signal; and an alarming device in communication with the controller;

wherein the controller is configured to transmit at least one alarm signal to the alarming device based on the at least one safety signal to activate an alarm;

wherein the service alarm device is configured to provide a warning if the elevator safety device is not activated as indicated by a first safety signal.

14. The assembly of claim 13, wherein the elevator safety device comprises a first switching device configured to transmit the first safety signal.

15. The assembly of claim 13, further comprising:

a first sensing device in communication with the service alarm device, wherein the first sensing device is configured to transmit a second safety signal; and a second sensing device in communication with the service alarm device, wherein the second sensing device is configured to transmit a third safety signal.

16. The assembly of claim 15, wherein the service alarm device is configured to activate an alarm signal if the second safety signal and the third safety signal are active, and the first safety signal is inactive.

17. The assembly of claim 13, further comprising a third sensing device in communication with the service alarm device, wherein the third sensing device is configured to transmit a fourth safety signal.

18. The assembly of claim 17, wherein the service alarm device is configured to activate at least one alarm signal if the fourth safety signal is active and the first safety signal is inactive.

19. The assembly of claim 13, wherein the service alarm device further comprises an alarm switching device in communication with the controller, wherein the alarm switching device is configured to transmit a fifth safety signal.

20. The assembly of claim 19, wherein the elevator safety device comprises a second switching device, wherein the second switching device is configured to transmit a sixth safety signal.

21. The assembly of claim 19, wherein the controller is configured to activate the alarming device if the fifth safety signal is active and the sixth safety signal is inactive.

22. The assembly of claim 19, wherein the assembly further comprises an auxiliary service device in communication with the controller, wherein the auxiliary service device is configured to temporarily disable the alarming device.

23. The assembly of claim 13, wherein the alarming device comprises at least one of a visual alarm and an audible alarm.

* * * * *